US012114688B2

(12) United States Patent
Dull

(10) Patent No.: US 12,114,688 B2
(45) Date of Patent: Oct. 15, 2024

(54) METHOD FOR FORMULATING AEROSOL PRECURSOR FOR AEROSOL DELIVERY DEVICE

(71) Applicant: RAI Strategic Holdings, Inc., Winston-Salem, NC (US)

(72) Inventor: Gary M. Dull, Lewisville, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 146 days.

(21) Appl. No.: 15/792,120

(22) Filed: Oct. 24, 2017

(65) Prior Publication Data

US 2019/0116863 A1 Apr. 25, 2019

(51) Int. Cl.
*A24B 15/16* (2020.01)
*A24B 15/167* (2020.01)

(52) U.S. Cl.
CPC ..... *A24B 15/167* (2016.11)

(58) Field of Classification Search
CPC .... A24B 15/167; A24F 47/008; A61K 31/465
USPC ..... 131/329
See application file for complete search history.

(56) References Cited

U.S. PATENT DOCUMENTS 4,449,541 A 5/1984 Mays et al.
4,506,682 A 3/1985 Muller
4,830,028 A 5/1989 Lawson et al.
4,836,224 A 6/1989 Lawson et al.
5,046,514 A 9/1991 Bolt
5,074,319 A 12/1991 White et al.
5,445,169 A 8/1995 Brinkley et al.
2005/0244339 A1* 11/2005 Jauernig ..... A61K 9/1075 424/45
2007/0020298 A1* 1/2007 Pipkin ..... A61K 31/724 424/400
2008/0230052 A1* 9/2008 Montaser ..... A61M 15/0085 128/200.16
2010/0242976 A1 9/2010 Katayama et al.
2013/0008457 A1 1/2013 Zheng et al.
2014/0044857 A1 2/2014 Jian
2014/0253144 A1* 9/2014 Novak, III ..... G01R 31/327 324/550
2014/0366902 A1 12/2014 Chiolini et al.
2015/0020823 A1 1/2015 Lipowicz et al.
2015/0020824 A1 1/2015 Bowen et al.
2015/0047661 A1* 2/2015 Blackley ..... H05B 3/12 131/329
2015/0083146 A1 3/2015 Goldman et al.
(Continued)

FOREIGN PATENT DOCUMENTS

WO WO 2012/019372 2/2012
WO WO 2012/019533 2/2012
(Continued)

*Primary Examiner* — Eric Yaary
(74) *Attorney, Agent, or Firm* — Womble Bond Dickinson (US) LLP

(57) ABSTRACT

A method for preparing an aerosol precursor composition is provided, which includes the steps of preparing an aqueous solution containing one or more organic acids and nicotine in water; and combining the aqueous solution with one or more vapor formers. The disclosed method can lead to enhanced control over the composition and characteristics of the produced aerosol precursor composition.

17 Claims, 3 Drawing Sheets

(56) References Cited

U.S. PATENT DOCUMENTS

| | | | | |
|---|---|---|---|---|
| 2015/0297580 | A1 | 10/2015 | Hearn et al. | |
| 2015/0313275 | A1 | 11/2015 | Anderson et al. | |
| 2016/0044967 | A1 | 2/2016 | Bowen | |
| 2016/0044968 | A1 | 2/2016 | Bowen | |
| 2016/0106144 | A1 | 4/2016 | Muehlbauer et al. | |
| 2016/0262443 | A1 | 9/2016 | Piccirilli et al. | |
| 2016/0262454 | A1* | 9/2016 | Sears | A24F 40/485 |
| 2016/0302471 | A1 | 10/2016 | Bowen et al. | |
| 2016/0345621 | A1 | 12/2016 | Li et al. | |
| 2017/0079319 | A1 | 3/2017 | Muhammad et al. | |
| 2017/0079322 | A1 | 3/2017 | Li et al. | |
| 2017/0086500 | A1 | 3/2017 | Li et al. | |
| 2017/0119040 | A1 | 5/2017 | Cameron | |
| 2017/0172204 | A1 | 6/2017 | Kane et al. | |
| 2017/0196266 | A1* | 7/2017 | Chen | A61M 11/041 |
| 2017/0304561 | A1* | 10/2017 | Hazani | A61M 11/003 |
| 2017/0333415 | A1* | 11/2017 | Williams | A61M 11/042 |
| 2018/0153208 | A1* | 6/2018 | Schaller | A24F 47/008 |
| 2019/0046436 | A1* | 2/2019 | Hazani | A61P 25/34 |

FOREIGN PATENT DOCUMENTS

| | | |
|---|---|---|
| WO | WO 2012/088675 | 7/2012 |
| WO | WO 2013/034488 | 3/2013 |
| WO | WO 2014/125340 | 8/2014 |
| WO | WO 2016/071705 | 5/2016 |
| WO | WO 2016/071706 | 5/2016 |
| WO | WO 2017/055866 | 4/2017 |
| WO | WO 2017/081480 | 5/2017 |

* cited by examiner

METHOD FOR FORMULATING AEROSOL PRECURSOR FOR AEROSOL DELIVERY DEVICE

FIELD OF THE INVENTION

The present disclosure relates to aerosol delivery devices such as smoking articles, and more particularly to aerosol delivery devices that may utilize electrically generated heat for the production of aerosol (e.g., smoking articles commonly referred to as electronic cigarettes). The smoking articles may be configured to heat an aerosol precursor, which may incorporate materials that may be made or derived from, or otherwise incorporate tobacco, the precursor being capable of forming an inhalable substance for human consumption.

BACKGROUND OF THE INVENTION

Many smoking devices have been proposed through the years as improvements upon, or alternatives to, smoking products that require combusting tobacco for use. Many of those devices purportedly have been designed to provide the sensations associated with cigarette, cigar or pipe smoking, but without delivering considerable quantities of incomplete combustion and pyrolysis products that result from the burning of tobacco. To this end, there have been proposed numerous smoking products, flavor generators and medicinal inhalers that utilize electrical energy to vaporize or heat a volatile material, or attempt to provide the sensations of cigarette, cigar or pipe smoking without burning tobacco to a significant degree. See, for example, the various alternative smoking articles, aerosol delivery devices and heat generating sources set forth in the background art described in U.S. Pat. No. 7,726,320 to Robinson et al. and U.S. Pat. No. 8,881,737 to Collett et al., which are incorporated herein by reference. See also, for example, the various types of smoking articles, aerosol delivery devices and electrically-powered heat generating sources referenced by brand name and commercial source in U.S. Pat. Pub. No. 2015/0216232 to Bless et al., which is incorporated herein by reference. Additionally, various types of electrically powered aerosol and vapor delivery devices also have been proposed in U.S. Pat. Appl. Pub. Nos. 2014/0096781 to Sears et al., 2014/0283859 to Minskoff et al., 2015/0335070 to Sears et al., 2015/0335071 to Brinkley et al., 2016/0007651 to Ampolini et al., and 2016/0050975 to Worm et al., all of which are incorporated herein by reference. Some of these alternative smoking articles, e.g., aerosol delivery devices, have replaceable cartridges or refillable tanks of aerosol precursor (e.g., smoke juice, e-liquid, or e-juice).

It would be desirable to provide alternative methods for preparing the aerosol precursor of such aerosol delivery devices.

SUMMARY OF THE INVENTION

The present disclosure is related to methods of preparing aerosol precursor compositions, e.g., for use in aerosol delivery devices such as electronic cigarettes, and to the compositions provided by such methods. Certain benefits, e.g., component stability are afforded by such methods, as will be outlined fully herein below.

In one aspect, a method for preparing an aerosol precursor composition is provided, the method comprising: preparing an aqueous solution comprising one or more organic acids and nicotine in water; and then combining that aqueous solution with one or more vapor formers to give an aerosol precursor composition.

In some embodiments, the aqueous solution contains at least one of the one or more organic acids in a given amount and the aerosol precursor composition contains the at least one of the one or more organic acids in a final amount that is close to the given amount. For example, the final amount, in certain embodiments, is about 75% or more of the given amount, about 80% or more of the given amount, or about 90% or more of the given amount. In some embodiments, the aqueous solution contains the one or more organic acids in a given amount and wherein the aerosol precursor composition contains the one or more organic acids in a final amount that is close to the given amount. For example, the final amount, in certain embodiments, is about 75% or more of the given amount, about 80% or more of the given amount, or about 90% or more of the given amount.

In some embodiments, the one or more organic acids are selected from the group consisting of levulinic acid, succinic acid, lactic acid, pyruvic acid, benzoic acid, fumaric acid, and combinations thereof. The one or more vapor formers can be, for example, polyols. Such polyols can include, but are not limited to, propylene glycol, glycerin, and combinations thereof.

The disclosed method, in certain embodiments, can be performed such that the preparing and combining steps are conducted in the absence of added heat. In some embodiments, the preparing step comprises a treatment selected from heating, agitating, stirring, and combinations thereof to provide the aqueous solution. The disclosed method may further comprise adding additional components before or after the combining step. Such additional components can include, but are not limited to, flavorants.

In some embodiments, the method further comprises incorporating the aerosol precursor composition within an aerosol delivery device, such as an electronic cigarette. The compositions provided according to the disclosed methods, as well as aerosol delivery devices including such compositions, are also disclosed herein.

These and other features, aspects, and advantages of the disclosure will be apparent from a reading of the following detailed description together with the accompanying drawings, which are briefly described below.

BRIEF DESCRIPTION OF THE DRAWING(S)

Having thus described the disclosure in the foregoing general terms, reference will now be made to the accompanying drawings, which are not necessarily drawn to scale, and wherein:

DETAILED DESCRIPTION OF THE INVENTION

Figure 1:
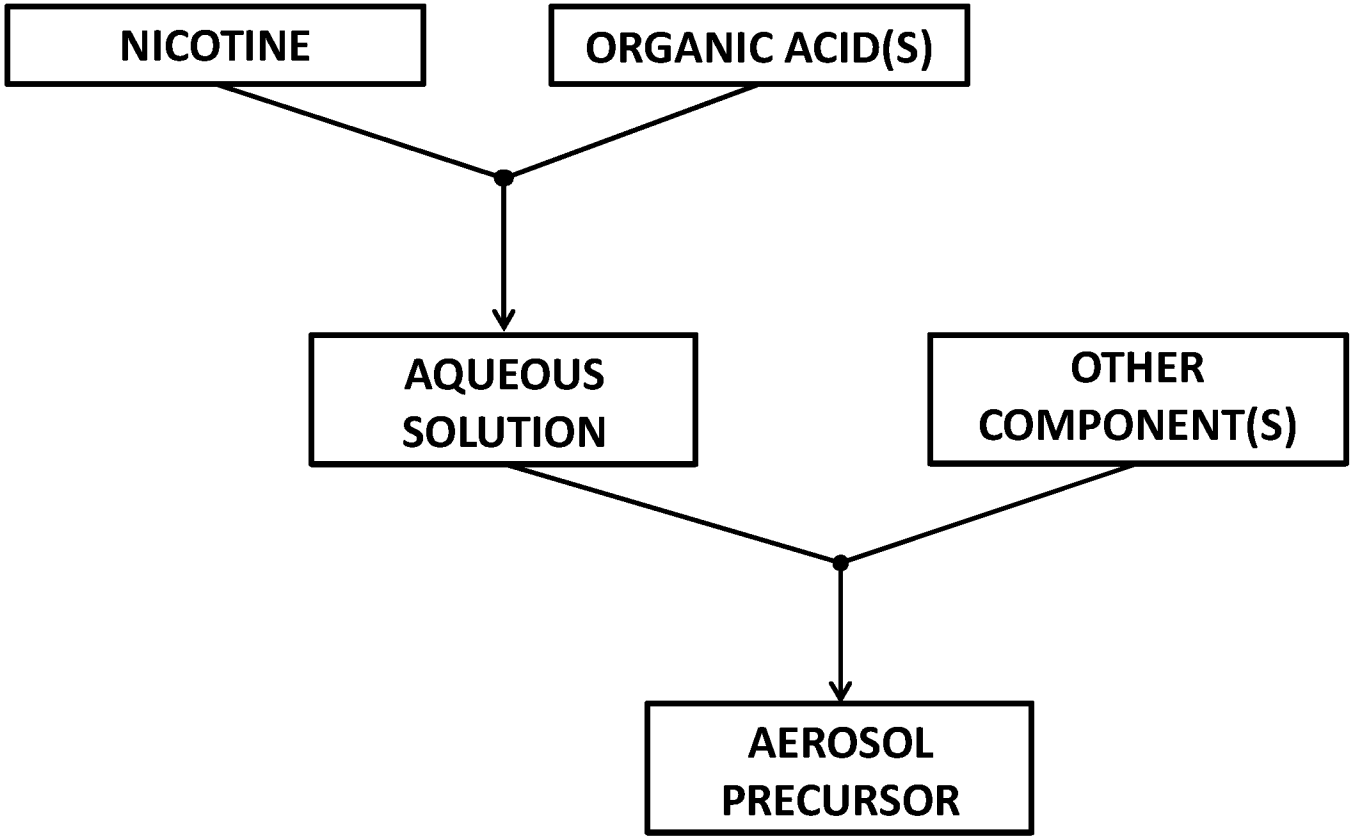
FIG. 1 is a flow chart of exemplary method steps of an embodiment of the present invention.

The present disclosure will now be described more fully hereinafter with reference to example implementations thereof. These example implementations are described so that this disclosure will be thorough and complete, and will fully convey the scope of the disclosure to those skilled in the art. Indeed, the disclosure may be embodied in many different forms and should not be construed as limited to the implementations set forth herein; rather, these implementations are provided so that this disclosure will satisfy applicable legal requirements. As used in the specification and the appended claims, the singular forms "a," "an," "the" and the like include plural referents unless the context clearly dictates otherwise.

As described hereinafter, the present disclosure relates to methods for preparing aerosol precursor mixtures for use in aerosol delivery systems. In particular, such methods comprise combining certain components to be included in the aerosol precursor mixture in a particular order to give an aerosol precursor that exhibits various desirable characteristics, e.g., ingredient concentrations consistent with targeted concentrations and good shelf stability. In particular, the disclosed methods may provide a relatively high degree of control over the composition and characteristics of the aerosol precursor mixtures.

Generally, aerosol precursors comprise a combination or mixture of various ingredients (i.e., components). The selection of the particular aerosol precursor components, and the relative amounts of those components used, may be modified in order to control the overall chemical composition of the mainstream aerosol produced by an atomizer of an aerosol delivery device. In some embodiments, an aerosol precursor composition can produce a visible aerosol upon the application of sufficient heat thereto (and cooling with air, if necessary), and the aerosol precursor composition can produce an aerosol that can be considered to be "smoke-like." In other embodiments, the aerosol precursor composition can produce an aerosol that can be substantially non-visible but can be recognized as present by other characteristics, such as flavor or texture. Thus, the nature of the produced aerosol can vary depending upon the specific components of the aerosol precursor composition. The aerosol precursor composition can be chemically simple relative to the chemical nature of the smoke produced by burning tobacco.

Of particular interest are aerosol precursors that can be characterized as being generally liquid in nature. For example, representative generally liquid aerosol precursors may have the form of liquid solutions, mixtures of miscible components, or liquids incorporating suspended or dispersed components, which are capable of being vaporized upon exposure to heat under those conditions that are experienced during use of aerosol delivery devices and hence are capable of yielding vapors and aerosols that are capable of being inhaled.

Aerosol precursors generally incorporate a so-called "aerosol former" component. Such materials have the ability to yield visible aerosols when vaporized upon exposure to heat under those conditions experienced during normal use of atomizers that are characteristic of the current disclosure. Such aerosol forming materials include various polyols/polyhydric alcohols (e.g., glycerin, propylene glycol, and mixtures thereof). Many embodiments of the present disclosure incorporate aerosol precursor components that can be characterized as water, moisture or aqueous liquid. During conditions of normal use of certain aerosol delivery devices, the water incorporated within those devices can vaporize to yield a component of the generated aerosol. As such, for purposes of the current disclosure, water that is present within the aerosol precursor may be considered to be an aerosol forming material. For example, aerosol precursor compositions can incorporate mixtures of glycerin and water, or mixtures of propylene glycol and water, or mixtures of propylene glycol and glycerin, or mixtures of propylene glycol, glycerin, and water.

Aerosol precursor compositions further can comprise one or more flavors, medicaments, or other inhalable materials. A variety of flavoring agents or flavor materials that alter the sensory character or nature of the drawn mainstream aerosol can be incorporated as components of the aerosol precursor. Flavoring agents may be added, e.g., to alter the flavor, aroma and/or organoleptic properties of the aerosol. Certain flavoring agents may be provided from sources other than tobacco. Flavoring agents may be natural or artificial in nature, and may be employed as concentrates or flavor packages.

Exemplary flavoring agents include vanillin, ethyl vanillin, cream, tea, coffee, fruit (e.g., apple, cherry, strawberry, peach and citrus flavors, including lime and lemon), floral flavors, savory flavors, maple, menthol, mint, peppermint, spearmint, wintergreen, nutmeg, clove, lavender, cardamom, ginger, honey, anise, sage, cinnamon, sandalwood, jasmine, cascarilla, cocoa, licorice, menthol, and flavorings and flavor packages of the type and character traditionally used for the flavoring of cigarette, cigar and pipe tobaccos. Exemplary plant-derived compositions that may be used are disclosed in U.S. application Ser. No. 12/971,746 to Dube et al. and U.S. application Ser. No. 13/015,744 to Dube et al., the disclosures of which are incorporated herein by reference in their entireties. Syrups, such as high fructose corn syrup, also can be employed. Certain flavoring agents may be incorporated within aerosol forming materials prior to formulation of a final aerosol precursor mixture (e.g., certain water soluble flavoring agents can be incorporated within water, menthol can be incorporated within propylene glycol, and certain complex flavor packages can be incorporated within propylene glycol).

Flavoring agents also can include acidic or basic characteristics (e.g., organic acids, ammonium salts, or organic amines. Organic acids particularly may be incorporated into the aerosol precursor to provide desirable alterations to the flavor, sensation, or organoleptic properties of medicaments, such as nicotine, that may be combined with the aerosol precursor. For example, organic acids, such as levulinic acid, succinic acid, lactic acid, pyruvic acid, benzoic acid, and/or fumaric acid may be included in the aerosol precursor with nicotine in amounts up to being equimolar (based on total organic acid content) with the nicotine. Any combination of organic acids can be used. For example, the aerosol precursor can include about 0.1 to about 0.5 moles of levulinic acid per one mole of nicotine, about 0.1 to about 0.5 moles of pyruvic acid per one mole of nicotine, about 0.1 to about 0.5 moles of lactic acid per one mole of nicotine, or combinations thereof, up to a concentration wherein the total amount of organic acid present is equimolar to the total amount of nicotine present in the aerosol precursor.

For aerosol delivery devices that are characterized as electronic cigarettes, the aerosol precursor most preferably incorporates tobacco or components derived from tobacco (referred to herein as "nicotine sources"). In one regard, the tobacco may be provided as parts or pieces of tobacco, such as finely ground, milled or powdered tobacco lamina. In another regard, the tobacco may be provided in the form of an extract, such as a spray dried extract that incorporates many of the water soluble components of tobacco. Alternatively, tobacco extracts may have the form of relatively high nicotine content extracts, which extracts also incorporate minor amounts of other extracted components derived from tobacco. In another regard, components derived from tobacco may be provided in a relatively pure form, such as certain flavoring agents that are derived from tobacco. In one regard, a component that is derived from tobacco, and that may be employed in a highly purified or essentially pure form, is nicotine (e.g., pharmaceutical grade nicotine).

In embodiments of the aerosol precursor material that contain a tobacco extract, including pharmaceutical grade nicotine derived from tobacco, it is advantageous for the tobacco extract to be characterized as substantially free of compounds collectively known as Hoffmann analytes, including, for example, tobacco-specific nitrosamines (TSNAs), including N'-nitrosonornicotine (NNN), (4-methylnitrosamino)-1-(3-pyridyl)-1-butanone (NNK), N'-nitrosoanatabine (NAT), and N'-nitrosoanabasine (NAB); polyaromatic hydrocarbons (PAHs), including benz[a]anthracene, benzo[a]pyrene, benzo[b]fluoranthene, benzo[k]fluoranthene, chrysene, dibenz[a,h]anthracene, and indeno[1,2,3-cd]pyrene, and the like. In certain embodiments, the aerosol precursor material can be characterized as completely free of any Hoffmann analytes, including TSNAs and PAHs. Embodiments of the aerosol precursor material may have TSNA levels (or other Hoffmann analyte levels) in the range of less than about 5 ppm, less than about 3 ppm, less than about 1 ppm, or less than about 0.1 ppm, or even below any detectable limit. Certain extraction processes or treatment processes can be used to achieve reductions in Hoffmann analyte concentration. For example, a tobacco extract can be brought into contact with an imprinted polymer or non-imprinted polymer such as described, for example, in U.S. Pat. No. 9,192,193 to Byrd et al.; and U.S. Pat. Pub. Nos. 2007/0186940 to Bhattacharyya et al; 2011/0041859 to Rees et al.; and 2011/0159160 to Jonsson et al, all of which are incorporated herein by reference. Further, the tobacco extract could be treated with ion exchange materials having amine functionality, which can remove certain aldehydes and other compounds. See, for example, U.S. Pat. No. 4,033,361 to Horsewell et al. and U.S. Pat. No. 6,779,529 to Figlar et al., which are incorporated herein by reference in their entireties.

The aerosol precursor composition may take on a variety of conformations based upon the various amounts of materials utilized therein. For example, a useful aerosol precursor composition may comprise up to about 98% by weight up to about 95% by weight, or up to about 90% by weight of a polyol. This total amount can be split in any combination between two or more different polyols. For example, one polyol can comprise about 50% to about 90%, about 60% to about 90%, or about 75% to about 90% by weight of the aerosol precursor, and a second polyol can comprise about 2% to about 45%, about 2% to about 25%, or about 2% to about 10% by weight of the aerosol precursor. A useful aerosol precursor also can comprise up to about 30% by weight, up to about 25% by weight, about 20% by weight or about 15% by weight water—particularly about 2% to about 30%, about 2% to about 25%, about 5% to about 20%, or about 7% to about 15% by weight water. Flavors and the like (which can include medicaments, such as nicotine) can comprise up to about 10%, up to about 8%, or up to about 5% by weight of the aerosol precursor. Typically, although not limited thereto, flavor compounds other than nicotine can be present at ppm or μg/g levels or about 0.004% to about 0.1%; some flavor compounds other than nicotine, such as menthol, can be present at higher levels, e.g., up to about 4% by weight (e.g., between about 1.5% and about 3% by weight) based on the aerosol precursor. Further, where menthol is used, the amount of water may, in some embodiments, desirably be minimized so as not to result in precipitation of the menthol. In some embodiments, the flavors are included within the aerosol precursor solution in the form of an aerosol former solution (e.g., in a water, propylene glycol, and/or glycerin solution), and in such embodiments, the flavor-containing aerosol former solution can be employed in an amount of about 5% to about 10% by weight based on the total aerosol precursor weight, wherein the one or more flavors can be included in various concentrations therein.

As a non-limiting example, an aerosol precursor according to the invention can comprise glycerol, propylene glycol, water, nicotine, and one or more flavors. Specifically, the glycerol can be present in an amount of about 70% to about 90% by weight, about 70% to about 85% by weight, about 70% to about 80%, or about 75% to about 85% by weight, the propylene glycol can be present in an amount of about 1% to about 10% by weight, about 1% to about 8% by weight, or about 2% to about 6% by weight, the water can be present in an amount of about 1% to about 30% by weight, such as about 1% to about 25% by weight, about 1% to about 10% by weight, about 1% to about 5%, about 10% to about 25% by weight, about 10% to about 20% by weight, about 12% to about 20% by weight, about 12% to about 16% by weight, the nicotine can be present in an amount of about 0.1% to about 7% by weight, about 0.1% to about 5% by weight, about 0.5% to about 4% by weight, or about 1% to about 3% by weight, and the flavors can be present in an amount of up to about 5% by weight, up to about 3% by weight, or up to about 1% by weight, all amounts being based on the total weight of the aerosol precursor. One specific, non-limiting example of an aerosol precursor comprises about 75% to about 80% by weight glycerol, about 13% to about 15% by weight water, about 4% to about 6% by weight propylene glycol, about 2% to about 3% by weight nicotine, and about 0.1% to about 0.5% by weight flavors. The nicotine, for example, can be a from a tobacco extract.

Another non-limiting example comprises a greater amount of propylene glycol, e.g., about 15% to about 40%, such as about 15% to about 30% or about 25% to about 35% by weight, with the glycerol present in a lower amount than in the above non-limiting example, such as about 40% to about 70% by weight or about 50% to about 70%, the water can be present in an amount of about 5% to about 20% by weight, about 10% to about 18% by weight, or about 12% to about 16% by weight, the nicotine can be present in an amount of about 0.1% to about 7% by weight, about 0.1% to about 5% by weight, about 0.5% to about 4% by weight, or about 1% to about 3% by weight, and the flavors can be present in an amount of up to about 5% by weight, up to about 3% by weight, or up to about 1% by weight, all amounts being based on the total weight of the aerosol precursor.

Representative types of aerosol precursor components and formulations are also set forth and characterized in U.S. Pat. No. 7,726,320 to Robinson et al. and U.S. Pat. Pub. Nos. 2013/0008457 to Zheng et al.; 2013/0213417 to Chong et al. and 2014/0060554 to Collett et al., 2015/0020823 to Lipowicz et al.; and 2015/0020830 to Koller, as well as WO 2014/182736 to Bowen et al, the disclosures of which are incorporated herein by reference. Additional aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. Exemplary aerosol precursor compositions also include those types of materials incorporated within devices available through Atlanta Imports Inc., Acworth, Ga., USA., as an electronic cigar having the brand name E-CIG, which can be employed using associated Smoking Cartridges Type C1a, C2a, C3a, C4a, C1b, C2b, C3b and C4b; and as Ruyan Atomizing Electronic Pipe and Ruyan Atomizing Electronic Cigarette from Ruyan SBT Technology and Development Co., Ltd., Beijing, China.

Other aerosol precursors that may be employed include the aerosol precursors that have been incorporated in the VUSE® product by R. J. Reynolds Vapor Company, the BLU™ product by Lorillard Technologies, the MISTIC MENTHOL product by Mistic Ecigs, and the VYPE product by CN Creative Ltd. Also desirable are the so-called "smoke juices" for electronic cigarettes that have been available from Johnson Creek Enterprises LLC. Embodiments of effervescent materials can be used with the aerosol precursor, and are described, by way of example, in U.S. Pat. App. Pub. No. 2012/0055494 to Hunt et al., which is incorporated herein by reference. Further, the use of effervescent materials is described, for example, in U.S. Pat. No. 4,639,368 to Niazi et al.; U.S. Pat. No. 5,178,878 to Wehling et al.; U.S. Pat. No. 5,223,264 to Wehling et al.; U.S. Pat. No. 6,974,590 to Pather et al.; and U.S. Pat. No. 7,381,667 to Bergquist et al., as well as U.S. Pat. Pub. Nos. 2006/0191548 to Strickland et al.; 2009/0025741 to Crawford et al; 2010/0018539 to Brinkley et al.; and 2010/0170522 to Sun et al.; and PCT WO 97/06786 to Johnson et al., all of which are incorporated by reference herein.

According to the disclosed method, certain components of the aerosol precursor are combined in a particular order. An exemplary flow chart showing certain steps in the preparation of an aerosol precursor is provided in FIG. 1. In particular, to prepare an aerosol precursor comprising nicotine, the nicotine is advantageously first combined with one or more organic acids. The combination of nicotine with the one or more organic acids can be conducted in various solvents, but preferably the solvent comprises water. The solvent can comprise additional solvents in addition to water, which preferably are miscible with the water and which do not negatively interact with the nicotine and/or organic acids. The order in which the nicotine, organic acid(s), and water are combined is not limited. For example, in some embodiments, both nicotine and one or more organic acids are independently provided as aqueous solutions/dispersions and the aqueous solutions/dispersions are combined. In some embodiments, nicotine and one or more organic acids are combined, and water is added thereto.

In other embodiments, water is provided and the nicotine and organic acid(s) are added thereto (in neat/solid form or in aqueous solution/dispersion). In further embodiments, neat nicotine is added to an aqueous solution/dispersion of one or more organic acids, and in still further embodiments, one or more organic acids are added to an aqueous solution of nicotine.

The amount of solvent employed for this mixing step can vary; however, in certain embodiments, it is beneficial to determine the maximum amount of a given solvent desired in the final aerosol precursor and to use an amount for this mixing step that is equal to or less than that maximum amount. For example, where the desired final aerosol precursor comprises 5% water by weight or less, the amount of water used in the mixing step is advantageously no more than that needed to provide 5% by weight in the final aerosol precursor. If necessary, the amount of water in this mixture can be modified as desired by adding more water thereto or by evaporating a portion of the water.

Although not intending to be limited by theory, it is believed that, in some embodiments, the initial combination of nicotine and organic acid(s) can help to stabilize the nicotine and/or organic acid(s). In some embodiments, the initial combination of nicotine and organic acid(s) may lead to the formation of nicotine salts (or other nicotine species, e.g., co-crystals) comprising the nicotine and the organic acid(s). Nicotine salts with various co-formers are described, for example, in U.S. Pat. No. 9,738,622 to Dull et al. and U.S. Pat. No. 9,215,895 to Bowen et al.; and in U.S. Patent Application Publication Nos. 2016/0185750 to Dull et al and 20150020824 to Bowen et al., which are all incorporated herein by reference in their entireties.

This step of combining nicotine with one or more organic acids generally results in the formation of an aqueous solution. By "aqueous solution" is meant a liquid wherein at least part of the solvent comprises water. The nicotine and organic acid(s) are typically fully dissolved, although the disclosure is not limited thereto, and it is possible to employ mixtures of nicotine and organic acid(s) wherein at least a portion of the nicotine and/or organic acid(s) are not completely dissolved, e.g., wherein some solid is dispersed within a liquid phase.

In some embodiments, this combining step is conducted at substantially room temperature, i.e., the nicotine, organic acid(s), and solvent are not exposed to elevated temperature in the preparation of the aerosol precursor. In some embodiments, the disclosed method comprises heating the nicotine, organic acid(s), and/or solvent(s), before or after combination. For example, in some embodiments, the mixture of nicotine and organic acid(s) in the solvent can be heated to facilitate dissolution of the nicotine and/or organic acid(s) within the solvent. Similarly, in some embodiments, the disclosed method further comprises agitating the mixture at this stage of the preparation process. Agitation can, in some embodiments, help to facilitate thorough mixing and dissolution of the nicotine and/or organic acid(s) in the solvent.

The specific techniques and apparatus used to mix these components can vary. In some embodiments, this combining step can be conducted within typical laboratory glassware such as a beaker or round bottomed flask with appropriate stirring (e.g., overhead paddle stirrer or magnetic stir bar). Such lab-scale equipment can be used to combine/mix components of the aqueous solution, as well as additional ingredients to provide an aerosol precursor. In some embodiments, a calorimeter (e.g., a Mettler Toledo RC1 calorimeter) can be employed to monitor the reaction exotherm. On a larger scale, large drums, steel totes, or glass-lined, jacketed reactors, e.g., such as those available from Pfaudler, can be used to combine/mix components of the aqueous solution, as well as additional ingredients to provide an aerosol precursor.

Following preparation of an aqueous solution as referenced herein above, various other components can be incorporated to give the final aerosol precursor. For example, the disclosed method generally further comprises adding one or more "aerosol former" components as referenced herein above to the aqueous solution. The disclosed method can further comprise adding one or more additional components desired in the final aerosol precursor, such as flavorants. Such additional components can be added independently or as mixtures of one or more such components. The additional components can be incorporated by any means known in the art, and in various amounts. Typically, the aqueous solution, if heated during the initial mixing step, is cooled to room temperature before adding the one or more additional components thereto. Further mixing can be conducted between each addition, where multiple components are added separately, and/or once all components are combined. Again, heating and/or agitation can be used at any step of the process, e.g., to promote dissolution/mixing. In one embodiment, the entire method is conducted in the absence of the application of heat, i.e., the method is done at room temperature. Advantageously, at least a majority of the process is conducted in the absence of heat, i.e., a majority of the process is conducted at room temperature. In one embodiment, nicotine and one or more organic acids are combined in water to create an aqueous solution and, subsequently, one or more flavorants are added thereto, and then one or more aerosol formers (e.g., polyols/polyhydric alcohols) are added to produce an aerosol precursor.

Advantageously, by first combining the nicotine and organic acid(s) in the absence of such "aerosol former" components (other than water, which is used in the first mixing step), undesired reactions between the organic acid(s) and the aerosol former components can be minimized. In particular, combining nicotine and organic acid(s) in the absence of polyols/polyhydric alcohols can minimize loss of organic acid(s) by formation of esters with the polyols/polyhydric alcohols. As such, the mixing method outlined herein can provide an aerosol precursor formulation with an organic acid(s) content that approximates the intended amount of organic acid(s) in the aerosol precursor.

For example, an amount "A" of an organic acid is calculated to ideally provide a desired weight percent "x" of Organic Acid A in the aerosol precursor, and thus, an amount "A" of the organic acid is used in the disclosed method. Advantageously, based on the disclosed method, the actual weight percent of Organic Acid A in the aerosol precursor does not deviate significantly from "x." For example, in some embodiments, the concentration of one or more organic acids in the aerosol precursor is no more than about 25% less than targeted, no more than about 20% less than targeted, no more than about 10% less than targeted, or no more than about 5% less than targeted. Where more than one different organic acid is used in the disclosed method, each organic acid can independently meet these limitations and/or the organic acids combined can meet these limitations. For example, in some embodiments, the concentration of one or more of the organic acids in the aerosol precursor is independently no more than about 25% less than targeted, no more than about 20% less than targeted, no more than about 10% less than targeted, or no more than about 5% less than targeted and/or the total concentration of organic acids in the aerosol precursor is no more than about 25% less than targeted, no more than about 20% less than targeted, no more than about 10% less than targeted, or no more than about 5% less than targeted.

It is noted that, although the disclosure relates principally to a method wherein nicotine is independently combined with the organic acid(s) in the absence of aerosol former components (other than water), it is not limited thereto. Certain benefits of the invention can be recognized in an alternative embodiment, e.g., where the organic acids and aerosol former components are combined and nicotine is added thereto. Although not intending to be limited by theory, it is believed that, in certain such systems, nicotine salt formation (i.e., reaction between nicotine and the one or more organic acids) can be more rapid than the undesired reaction between the organic acid(s) and the aerosol former(s). Therefore, such methods are also intended to be encompassed within the scope of the disclosed invention.

The method of the invention, leading to the retention of more of the added organic acid(s) in the aerosol precursor, provides certain benefits. For example, it is understood that organic acids in an aerosol precursor can be advantageous in ensuring protonation of at least a portion of the nicotine present in the aerosol precursor. Such protonation desirably leads to an aerosol produced from the precursor that provides low to mild harshness in the throat of the user. It is generally understood that if too little acid is included within an aerosol precursor, a larger amount of nicotine will remain unprotonated and in the gas phase of the aerosol, the user will experience increased throat harshness. See, e.g., U.S. Pat. Appl. Publ. No. 20150020823 to Lipowicz et al., which is incorporated herein by reference. As such, the methods of the invention, which can provide an amount of organic acid(s) in an aerosol precursor that is close to the target amount, can lead to desirable sensory/taste characteristics (e.g., decreased harshness).

In some embodiments, the pH of the aerosol precursor can be maintained within a desired range. Again, by limiting the amount of side reactions, the target pH of the aerosol precursor may be more accurately obtained. In some embodiments, the method disclosed herein additionally provides an aerosol precursor with decreased side product content. Again, the present method is designed to specifically avoid certain interactions between components of the aerosol precursor and, accordingly, by minimizing such interactions, fewer side products may be formed. Generally, the disclosed method may provide enhanced control over the composition (e.g., amount of organic acid(s), amount of undesirable side products, etc.) and characteristics (e.g., pH, stability) of the aerosol precursor composition produced thereby.

In some embodiments, there may be further benefits provided by conducting the aerosol precursor preparation substantially at room temperature (wherein the majority of the process is conducted without added heat). By not exposing the components of the aerosol precursor to heat, again, the resulting product may, in some embodiments, be more stable and may, in some embodiments, exhibit amounts of various components that are close to the target amounts of such components.

The disclosed method can further comprise incorporating the aerosol precursor within an aerosol delivery system, as generally known in the art. Aerosol delivery systems generally use electrical energy to heat a material (preferably without combusting the material to any significant degree) to form an inhalable substance; and components of such systems have the form of articles most preferably are sufficiently compact to be considered hand-held devices. That is, use of components of preferred aerosol delivery systems does not result in the production of smoke in the sense that aerosol results principally from by-products of combustion or pyrolysis of tobacco, but rather, use of those preferred systems results in the production of vapors resulting from volatilization or vaporization of certain components incorporated therein. In some example implementations, components of aerosol delivery systems may be characterized as electronic cigarettes, and those electronic cigarettes most preferably incorporate tobacco and/or components derived from tobacco, and hence deliver tobacco derived components in aerosol form. Aerosol delivery systems into which aerosol precursors prepared as disclosed herein can be incorporated also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

Aerosol delivery systems generally include a number of components provided within an outer body or shell, which may be referred to as a housing. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary housing or the elongated housing can be formed of two or more separable bodies. For example, an aerosol delivery device can comprise an elongated shell or body that can be substantially tubular in shape and, as such, resemble the shape of a conventional cigarette or cigar. In one example, all of the components of the aerosol delivery device are contained within one housing. Alternatively, an aerosol delivery device can comprise two or more housings that are joined and are separable. For example, an aerosol delivery device can possess at one end a control body comprising a housing containing one or more reusable components (e.g., an accumulator such as a rechargeable battery and/or capacitor, and various electronics for controlling the operation of that article), and at the other end and removably coupleable thereto, an outer body or shell containing a disposable portion (e.g., a disposable flavor-containing cartridge). See also the types of devices set forth in U.S. patent application Ser. No. 15/708,729 to Sur et al., filed Sep. 19, 2017 and U.S. patent application Ser. No. 15/417,376 to Sur et al., filed Jan. 27, 2017, which are incorporated herein by reference in their entireties.

Aerosol delivery systems of the present disclosure most preferably comprise some combination of a power source (i.e., an electrical power source), at least one control component (e.g., means for actuating, controlling, regulating and ceasing power for heat generation, such as by controlling electrical current flow the power source to other components of the article—e.g., an analog electronic control component), a heater or heat generation member (e.g., an electrical resistance heating element or other component, which alone or in combination with one or more further elements may be commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined airflow path through the article such that aerosol generated can be withdrawn therefrom upon draw).

The selection and arrangement of various aerosol delivery system components can be appreciated, e.g., upon consideration of the commercially available electronic aerosol delivery devices, such as those representative products referenced in background art section of the present disclosure. In various examples, an aerosol delivery device can comprise a reservoir configured to retain the aerosol precursor composition. The reservoir particularly can be formed of a porous material (e.g., a fibrous material) and thus may be referred to as a porous substrate (e.g., a fibrous substrate). The reservoir may also be contained within or otherwise surrounded by a ferrite material to facilitate induction heating.

A fibrous substrate useful as a reservoir in an aerosol delivery device can be a woven or nonwoven material formed of a plurality of fibers or filaments and can be formed of one or both of natural fibers and synthetic fibers. For example, a fibrous substrate may comprise a fiberglass material. In particular examples, a cellulose acetate material can be used. In other example implementations, a carbon material can be used. A reservoir may be substantially in the form of a container and may include a fibrous material included therein.

Figure 2:
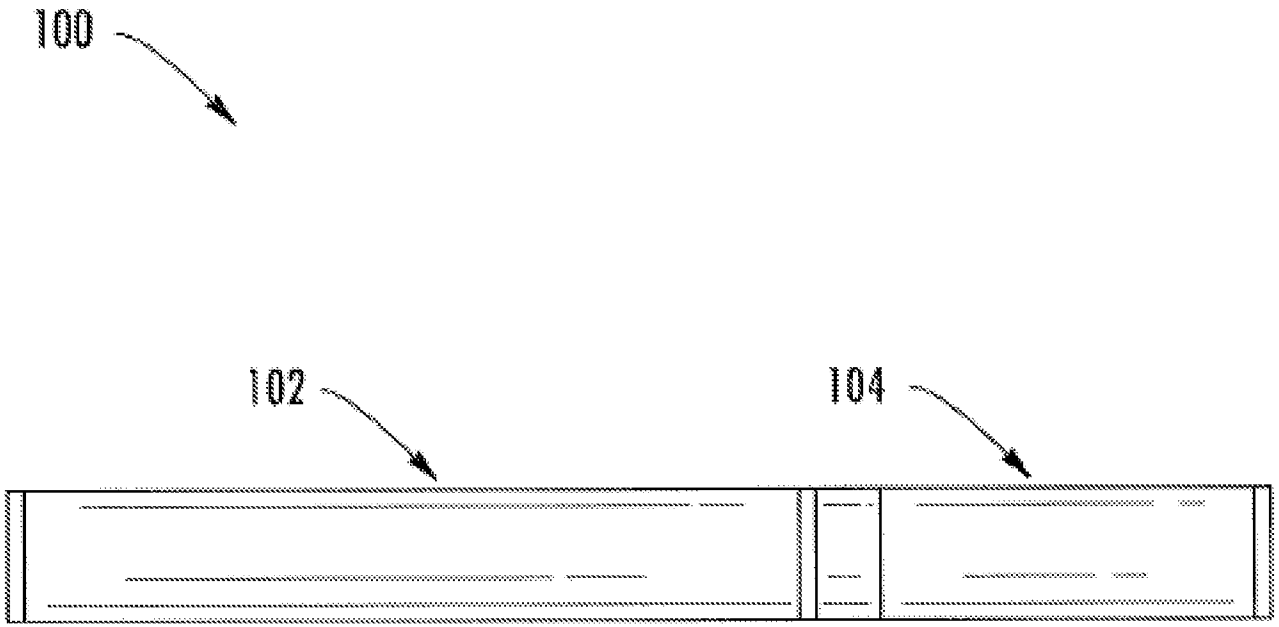
FIG. 2 illustrates a side view of an aerosol delivery device including a cartridge coupled to a control body, according to an example implementation of the present disclosure.

FIG. 2 illustrates a side view of an aerosol delivery device 100 including a control body 102 and a cartridge 104, according to various example implementations of the present disclosure. In particular, FIG. 1 illustrates the control body and the cartridge coupled to one another. The control body and the cartridge may be detachably aligned in a functioning relationship. Various mechanisms may connect the cartridge to the control body to result in a threaded engagement, a press-fit engagement, an interference fit, a magnetic engagement or the like. The aerosol delivery device may be substantially rod-like, substantially tubular shaped, or substantially cylindrically shaped in some example implementations when the cartridge and the control body are in an assembled configuration. The aerosol delivery device may also be substantially rectangular or rhomboidal in cross-section, which may lend itself to greater compatibility with a substantially flat or thin-film power source, such as a power source including a flat battery. The cartridge and control body may include separate, respective housings or outer bodies, which may be formed of any of a number of different materials. The housing may be formed of any suitable, structurally-sound material. In some examples, the housing may be formed of a metal or alloy, such as stainless steel, aluminum or the like. Other suitable materials include various plastics (e.g., polycarbonate), metal-plating over plastic, ceramics and the like.

In some example implementations, one or both of the control body 102 or the cartridge 104 of the aerosol delivery device 100 may be referred to as being disposable or as being reusable. For example, the control body may have a replaceable battery or a rechargeable supercapacitor, and thus may be combined with any type of recharging technology, including connection to a typical wall outlet, connection to a car charger (i.e., a cigarette lighter receptacle), connection to a computer, such as through a universal serial bus (USB) cable or connector, connection to a wireless radio-frequency (RF) charger, or connection to a photovoltaic cell (sometimes referred to as a solar cell) or solar panel of solar cells. Some examples of suitable recharging technology are described below. Further, in some example implementations, the cartridge may comprise a single-use cartridge, as disclosed in U.S. Pat. No. 8,910,639 to Chang et al., which is incorporated herein by reference in its entirety.

Figure 3:
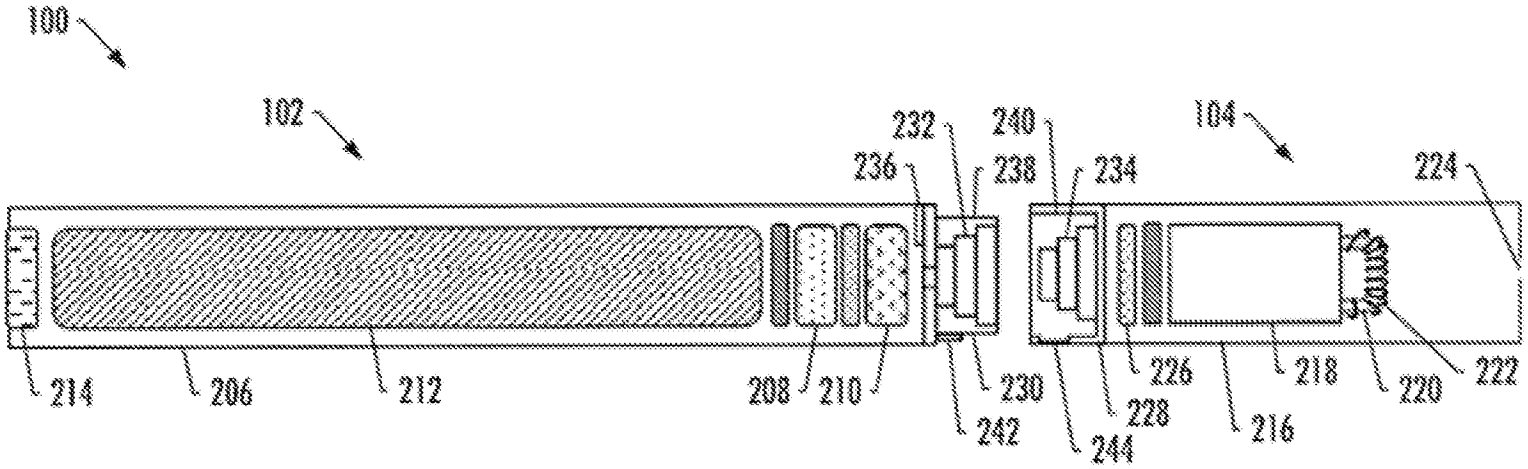
FIG. 3 is a partially cut-away view of the aerosol delivery device according to various example implementations.

FIG. 3 more particularly illustrates the aerosol delivery device 100, in accordance with some example implementations. As seen in the cut-away view illustrated therein, again, the aerosol delivery device can comprise a control body 102 and a cartridge 104 each of which include a number of respective components. The components illustrated in FIG. 3 are representative of the components that may be present in a control body and cartridge and are not intended to limit the scope of components that are encompassed by the present disclosure. As shown, for example, the control body can be formed of a control body shell 206 that can include various electronic components such as a control component 208 (e.g., an electronic analog component), a sensor 210, a power source 212 and one or more light-emitting diodes (LEDs) 214 (e.g., organic light emitting diodes (OLEDs)) and such components can be variably aligned. The flow sensor may include a number of suitable sensors such as an accelerometer, gyroscope, optical sensor, proximity sensor, or the like.

The power source 212 may be or include a suitable power supply such as a lithium-ion battery, solid-state battery or supercapacitor as disclosed in U.S. patent application Ser. No. 14/918926 to Sur et al. which is incorporated herein by reference. Examples of suitable solid-state batteries include STMicroelectronics' EnFilm™ rechargeable solid-state lithium thin-film batteries. Examples of suitable supercapacitors include electric double-layer capacitor (EDLC), a hybrid capacitor such as a lithium-ion capacitor (LIC), or the like.

In some example implementations, the power source 212 may be a rechargeable power source configured to deliver current to the control component 208 (e.g., an analog electronic component). In these examples, the power source may be connected to a charging circuit via a resistance temperature detector (RTD). The RTD may be configured to signal the charging circuit when the temperature of the power source exceeds a threshold amount, and the charging circuit may disable charging of the power source in response thereto. In these examples, safe charging of the power source may be ensured independent of a digital processor (e.g., a microprocessor) and/or digital processing logic.

The LEDs 214 may be one example of a suitable visual indicator with which the aerosol delivery device 100 may be equipped. In some examples, the LEDs may include organic LEDs or quantum dot-enabled LEDs. Other indicators such as audio indicators (e.g., speakers), haptic indicators (e.g., vibration motors) or the like can be included in addition to or as an alternative to visual indicators such as the LEDs including the organic LEDs or quantum dot-enabled LEDs.

The cartridge 104 can be formed of a cartridge shell 216 enclosing a reservoir 218 that is in fluid communication with a liquid transport element 220 adapted to wick or otherwise transport an aerosol precursor composition stored in the reservoir housing to a heater 222 (sometimes referred to as a heating element). In various configurations, this structure may be referred to as a tank; and accordingly, the terms "tank," "cartridge" and the like may be used interchangeably to refer to a shell or other housing enclosing a reservoir for aerosol precursor composition, and including a heater. In some example, a valve may be positioned between the reservoir and heater, and configured to control an amount of aerosol precursor composition passed or delivered from the reservoir to the heater.

Various examples of materials configured to produce heat when electrical current is applied therethrough may be employed to form the heater 222. The heater in these examples may be a resistive heating element such as a wire coil, microheater or the like. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), Titanium (Ti), graphite and graphite-based materials (e.g., carbon-based foams and yarns) and ceramics (e.g., positive or negative temperature coefficient ceramics). Example implementations of heaters or heating members useful in aerosol delivery devices according to the present disclosure are further described below, and can be incorporated into devices such as illustrated in FIG. 3 as described herein.

An opening 224 may be present in the cartridge shell 216 (e.g., at the mouthend) to allow for egress of formed aerosol from the cartridge 104. In addition to the heater 222, the cartridge 104 also may include one or more other electronic components 226. These electronic components may include an integrated circuit, a memory component, a sensor, or the like. The electronic components may be adapted to communicate with the control component 208 and/or with an external device by wired or wireless means. The electronic components may be positioned anywhere within the cartridge or a base 228 thereof.

Although the control component 208 and the sensor 210 are illustrated separately, it is understood that the control component and the sensor may be combined as an electronic circuit board. Further, the electronic circuit board may be positioned horizontally relative the illustration of FIG. 3 in that the electronic circuit board can be lengthwise parallel to the central axis of the control body. In some examples, the sensor may comprise its own circuit board or other base element to which it can be attached. In some examples, a flexible circuit board may be utilized. A flexible circuit board may be configured into a variety of shapes, include substantially tubular shapes. In some examples, a flexible circuit board may be combined with, layered onto, or form part or all of a heater substrate as further described below.

The control body 102 and the cartridge 104 may include components adapted to facilitate a fluid engagement therebetween. As illustrated in FIG. 3, the control body can include a coupler 230 having a cavity 232 therein. The base 228 of the cartridge can be adapted to engage the coupler and can include a projection 234 adapted to fit within the cavity. Such engagement can facilitate a stable connection between the control body and the cartridge as well as establish an electrical connection between the power source 212 and control component 208 in the control body and the heater 222 in the cartridge. Further, the control body shell 206 can include an air intake 236, which may be a notch in the shell where it connects to the coupler that allows for passage of ambient air around the coupler and into the shell where it then passes through the cavity 232 of the coupler and into the cartridge through the projection 234.

In use, the heater 222 is activated to vaporize components of the aerosol precursor composition. Drawing upon the mouthend of the aerosol delivery device causes ambient air to enter the air intake 236 and pass through the cavity 232 in the coupler 230 and the central opening in the projection 234 of the base 228. In the cartridge 104, the drawn air combines with the formed vapor to form an aerosol. The aerosol is whisked, aspirated or otherwise drawn away from the heater and out the opening 224 in the mouthend of the aerosol delivery device.

A coupler and a base useful according to the present disclosure are described in U.S. Pat. App. Pub. No. 2014/0261495 to Novak et al., which is incorporated herein by reference in its entirety. For example, the coupler 230 as seen in FIG. 3 may define an outer periphery 238 configured to mate with an inner periphery 240 of the base 228. In one example the inner periphery of the base may define a radius that is substantially equal to, or slightly greater than, a radius of the outer periphery of the coupler. Further, the coupler may define one or more protrusions 242 at the outer periphery configured to engage one or more recesses 244 defined at the inner periphery of the base. However, various other examples of structures, shapes and components may be employed to couple the base to the coupler. In some examples the connection between the base of the cartridge 104 and the coupler of the control body 102 may be substantially permanent, whereas in other examples the connection therebetween may be releasable such that, for example, the control body may be reused with one or more additional cartridges that may be disposable and/or refillable.

The aerosol delivery device 100 may be substantially rod-like or substantially tubular shaped or substantially cylindrically shaped in some examples. In other examples, further shapes and dimensions are encompassed—e.g., a rectangular or triangular cross-section, multifaceted shapes, or the like.

The reservoir 218 illustrated in FIG. 3 can be a container or can be a fibrous reservoir, as presently described. For example, the reservoir can comprise one or more layers of nonwoven fibers substantially formed into the shape of a tube encircling the interior of the cartridge shell 216, in this example. An aerosol precursor composition can be retained in the reservoir. Liquid components, for example, can be sorptively retained by the reservoir. The reservoir can be in fluid connection with the liquid transport element 220. The liquid transport element can transport the aerosol precursor composition stored in the reservoir via capillary action to the heater 222 that is in the form of a metal wire coil in this example. As such, the heater is in a heating arrangement with the liquid transport element. Example implementations of reservoirs and transport elements useful in aerosol delivery devices according to the present disclosure are further described below, and such reservoirs and/or transport elements can be incorporated into devices such as illustrated in FIG. 3 as described herein. In particular, specific combinations of heating members and transport elements as further described below may be incorporated into devices such as illustrated in FIG. 3 as described herein.

The various components of an aerosol delivery device can be chosen from components described in the art and commercially available. Examples of batteries that can be used according to the disclosure are described in U.S. Pat. App. Pub. No. 2010/0028766 to Peckerar et al., which is incorporated herein by reference in its entirety.

The aerosol delivery device 100 can incorporate the sensor 210 or another sensor or detector for control of supply of electric power to the heater 222 when aerosol generation is desired. As such, for example, there is provided a manner or method of turning off power to the heater when the aerosol delivery device, and for turning on power to actuate or trigger the generation of heat by the heater during draw. Additional representative types of sensing or detection mechanisms, structure and configuration thereof, components thereof, and general methods of operation thereof, are described in U.S. Pat. No. 5,261,424 to Sprinkel, Jr., U.S. Pat. No. 5,372,148 to McCafferty et al., and PCT Pat. App. Pub. No. WO 2010/003480 to Flick, all of which are incorporated herein by reference in their entireties.

The aerosol delivery device 100 most preferably incorporates the control component 208 or another control mechanism for controlling the amount of electric power to the heater 222. Representative types of electronic components, structure and configuration thereof, features thereof, and general methods of operation thereof, are described in U.S. Pat. No. 4,735,217 to Gerth et al., U.S. Pat. No. 4,947,874 to Brooks et al., U.S. Pat. No. 5,372,148 to McCafferty et al., U.S. Pat. No. 6,040,560 to Fleischhauer et al., U.S. Pat. No. 7,040,314 to Nguyen et al., U.S. Pat. No. 8,205,622 to Pan, U.S. Pat. App. Pub. No. 2009/0230117 to Fernando et al., U.S. Pat. App. Pub. No. 2014/0060554 to Collet et al., U.S. Pat. App. Pub. No. 2014/0270727 to Ampolini et al., and U.S. Pat. App. Pub. No. 2015/0257445 to Henry et al., all of which are incorporated herein by reference in their entireties.

Representative types of substrates, reservoirs or other components for supporting the aerosol precursor are described in U.S. Pat. No. 8,528,569 to Newton and U.S. Pat. App. Pub. Nos. 2014/0261487 to Chapman et al., 2015/0059780 to Davis et al., and 2015/0216232 to Bless et al., all of which are incorporated herein by reference in their entireties. Additionally, various wicking materials, and the configuration and operation of those wicking materials within certain types of electronic cigarettes, are set forth in U.S. Pat. App. Pub. No. 2014/0209105 to Sears et al., which is incorporated herein by reference in its entirety.

Additional representative types of components that yield visual cues or indicators may be employed in the aerosol delivery device 100, such as visual indicators and related components, audio indicators, haptic indicators and the like. Examples of suitable LED components, and the configurations and uses thereof, are described in U.S. Pat. No. 5,154,192 to Sprinkel et al., U.S. Pat. No. 8,499,766 to Newton, U.S. Pat. No. 8,539,959 to Scatterday, and U.S. Pat. No. 9,451,791 to Sears et al., all of which are incorporated herein by reference in their entireties.

Yet other features, controls or components that can be incorporated into aerosol delivery devices of the present disclosure are described in U.S. Pat. No. 5,967,148 to Harris et al., U.S. Pat. No. 5,934,289 to Watkins et al., U.S. Pat. No. 5,954,979 to Counts et al., U.S. Pat. No. 6,040,560 to Fleischhauer et al., U.S. Pat. No. 8,365,742 to Hon, U.S. Pat. No. 8,402,976 to Fernando et al., U.S. Pat. App. Pub. No. 2005/0016550 to Katase, U.S. Pat. App. Pub. No. 2010/0163063 to Fernando et al., U.S. Pat. App. Pub. No. 2013/0192623 to Tucker et al., U.S. Pat. App. Pub. No. 2013/0298905 to Leven et al., U.S. Pat. App. Pub. No. 2013/0180553 to Kim et al., U.S. Pat. App. Pub. No. 2014/0000638 to Sebastian et al., U.S. Pat. App. Pub. No. 2014/0261495 to Novak et al., and U.S. Pat. App. Pub. No. 2014/0261408 to DePiano et al., all of which are incorporated herein by reference in their entireties.

The control component 208 includes a number of electronic components, and in some examples may be formed of a printed circuit board (PCB) that supports and electrically connects the electronic components. The electronic components may include an analog electronic component configured to operate independent of a digital processor (e.g., a microprocessor) and/or digital processing logic. In some examples, the control component may be coupled to a communication interface to enable wireless communication with one or more networks, computing devices or other appropriately-enabled devices. Examples of suitable communication interfaces are disclosed in U.S. Pat. App. Pub. No. 2016/0261020 to Marion et al., the contents of which is incorporated by reference in its entirety. And examples of suitable manners according to which the aerosol delivery device may be configured to wirelessly communicate are disclosed in U.S. Pat. App. Pub. No. 2016/0007651 to Ampolini et al. and U.S. Pat. App. Pub. No. 2016/0219933 to Henry, Jr. et al., each of which is incorporated herein by reference in its entirety.

EXAMPLE

Organic acids are added to a mixing vessel and water is added. The mixture is stirred until dissolution occurs, giving an aqueous solution. Nicotine is slowly added to the aqueous solution and the solution is subsequently cooled to room temperature (if necessary). Flavorant is added to the cooled aqueous solution. Subsequently, aerosol formers are added and the mixture is stirred thoroughly to obtain a homogenous mixture.

Various such mixtures were prepared and analyzed for acid content. Acid contents were largely found to be comparable to the targeted acid contents. The mixtures were maintained for 6 weeks at room temperature in opaque bottles and acid levels were found to be constant over this time period. Further, other comparable mixtures were maintained in opaque bottles for 4 weeks at room temperature, followed by exposure to accelerated test conditions (40° C./75% RH in a stability chamber). Again, acid levels were found to be constant over this time/accelerated condition study.

Many modifications and other implementations of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific implementations disclosed, and that modifications and other implementations are intended to be included within the scope of the appended claims. Moreover, although the foregoing descriptions and the associated drawings describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method for preparing an aerosol precursor composition, comprising:

a. preparing an aqueous solution consisting essentially of one or more organic acids, nicotine, water, and optionally one or more additional solvents;

b. adding one or more flavoring agents to alter flavor, aroma, or organoleptic properties of an aerosol produced from the aerosol precursor composition; and c. combining the aqueous solution with one or more vapor formers to give an aerosol precursor composition, wherein the aqueous solution contains at least one of the one or more organic acids in a given amount and wherein the aerosol precursor composition contains the at least one of the one or more organic acids in a final amount that is about 75% or more of the given amount, wherein the preparing, adding, and combining steps are conducted in the absence of added heat.

2. The method of claim 1, wherein the final amount is about 80% or more of the given amount.

3. The method of claim 1, wherein the final amount is about 90% or more of the given amount.

4. The method of claim 1, wherein the final amount is about 80% or more of the given amount.

5. The method of claim 1, wherein the final amount is about 90% or more of the given amount.

6. The method of claim 1, wherein the one or more organic acids are selected from the group consisting of levulinic acid, succinic acid, lactic acid, pyruvic acid, benzoic acid, fumaric acid, and combinations thereof.

7. The method of claim 1, wherein the one or more vapor formers are polyols.

8. The method of claim 1, wherein the preparing step comprises a treatment selected from agitating, stirring, and combinations thereof to provide the aqueous solution.

9. The method of claim 1, further comprising adding additional components before or after the combining step.

10. The method of claim 1, further comprising incorporating the aerosol precursor composition within an aerosol delivery device.

11. The method of claim 1, wherein the aqueous solution consists essentially of the one or more organic acids and nicotine in water.

12. The method of claim 1, wherein the one or more flavoring agents are natural.

13. The method of claim 1, wherein the one or more flavoring agents are artificial.

14. The method of claim 1, wherein the one or more flavoring agents are selected from vanillin, ethyl vanillin, cream, tea, coffee, fruit, maple, menthol, mint, peppermint, spearmint, wintergreen, nutmeg, clove, lavender, cardamom, ginger, honey, anise, sage, cinnamon, sandalwood, jasmine, cascarilla, cocoa, licorice, menthol, and combinations thereof.

15. The method of claim 1, wherein the one or more flavoring agents are derived from tobacco.

16. The method of claim 1, wherein the one or more flavoring agents are in an amount of up to about 5% by weight of the aerosol precursor composition.

17. The method of claim 1, wherein the one or more flavoring agents are in an amount of about 0.1 to about 0.5% by weight of the aerosol precursor composition.

* * * * *